United States Patent [19]

Crumrine, Jr. et al.

[11] 4,131,156

[45] Dec. 26, 1978

[54] FAN SHROUD

[75] Inventors: Albert W. Crumrine, Jr., Peoria; Theodore H. Fones, Washington; James M. Kostas, Peoria; Raymond M. Vanderburg, Washington, all of Ill.

[73] Assignee: Caterpillar Tractor Co., Peoria, Ill.

[21] Appl. No.: 731,473

[22] Filed: Oct. 12, 1976

[51] Int. Cl.[2] ..... F28F 13/12

[52] U.S. Cl. ..... 165/51; 123/41.49; 165/122; 415/219 R

[58] Field of Search ..... 123/41.49, 41.65, 41.66; 165/41, 51, 122; 415/172 R, 172 A, 219 C, 219 R

[56] References Cited

U.S. PATENT DOCUMENTS

| | | | |
|---|---|---|---|
| 2,186,837 | 1/1940 | McMahan | 123/41.49 |
| 2,668,523 | 2/1954 | Lamb | 123/41.49 |
| 3,144,859 | 8/1964 | Walton | 123/41.49 |
| 3,358,655 | 12/1967 | Camps | 165/51 |
| 3,680,977 | 8/1972 | Rabouyt et al. | 415/172 A |
| 3,794,001 | 2/1974 | Birch et al. | 123/41.49 |
| 3,842,902 | 10/1974 | Poslusny | 123/41.49 |
| 3,980,132 | 9/1976 | Mitchell et al. | 165/122 |

FOREIGN PATENT DOCUMENTS

| | | | |
|---|---|---|---|
| 770,848 | 3/1957 | United Kingdom | 123/41.49 |

*Primary Examiner*—Charles J. Myhre
*Assistant Examiner*—Sheldon Richter
*Attorney, Agent, or Firm*—Wegner, Stellman, McCord, Wiles & Wood

[57] ABSTRACT

An improved fan construction for use with engines utilizing circulating coolant and radiators, including a shaft adapted to be mounted on an engine or the like, a sheave journalled on the shaft, and fan blades carried by the sheave and rotatable therewith. An annular ring of resilient material is disposed about the fan blades and has an inner diameter spaced slightly radially outwardly of the tips of the fan blades and an outer periphery adapted to slidably, peripherally, sealingly engage a radiator shroud or the like about the periphery of an orifice therein and a perforate support for the ring secured to both the ring and the shaft.

11 Claims, 4 Drawing Figures

66
16
22
34
52
44
50
32
24
20
48
46
54
30
58
28
62
56
60
64
42
68
44
40
16'
36
66
10
3
78
70
80
86
72
74
76
84
18
82
3

Fig. 3.
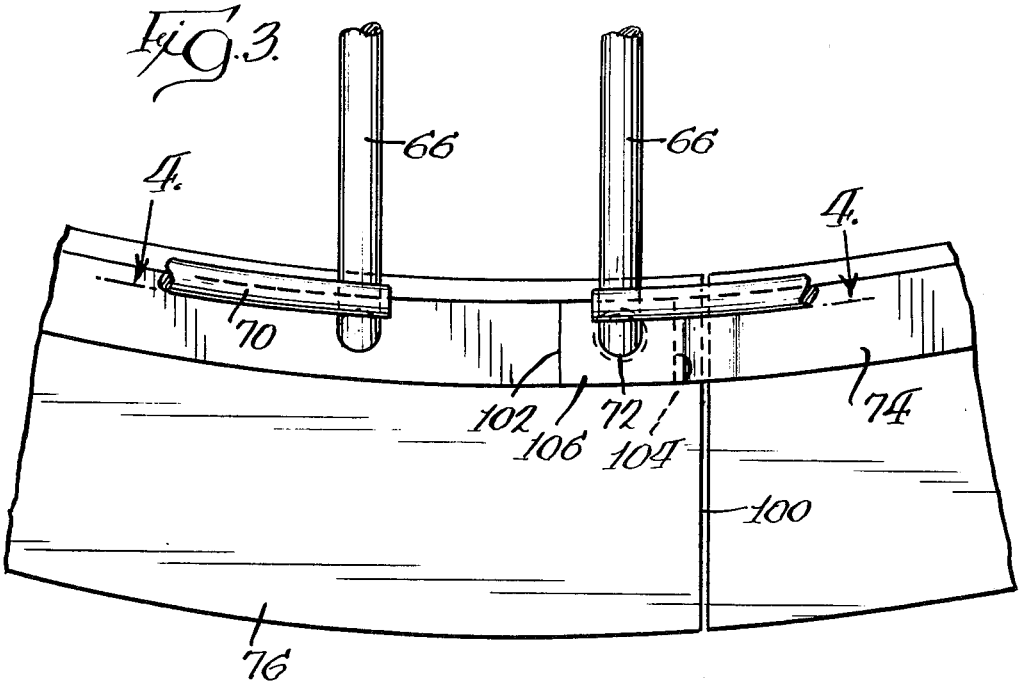
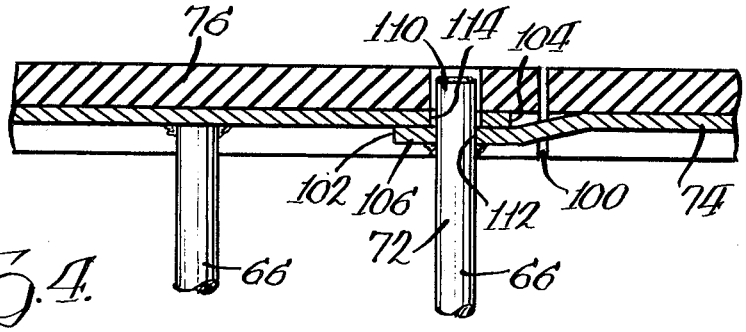
Fig. 4.

FAN SHROUD

BACKGROUND OF THE INVENTION

This invention relates to fan constructions for use with, for example, internal combustion engines employing circulating liquid coolants and radiators.

Prior art of possible relevance includes the following U.S. Pat. Nos. 2,668,523 issued Feb. 9, 1954 to Lamb; 3,680,977 issued Aug. 1, 1972 to Rabouyt et al; and 3,794,001 issued Feb. 26, 1974 to Birch et al.

In most applications utilizing internal combustion engines having circulating coolant and radiators, the radiator is mounted rigidly on a frame while the engine is resiliently mounted on the frame. A fan driven by the engine is generally mounted on the engine itself and rotates within an orifice in a shroud fixedly attached to the radiator. The engine will move in relation to the radiator due to deflection in the respective mounting components. Where the apparatus is part of a vehicle, the relative movement is accentuated by deflection of the frame caused by unevenness in the terrain over which the vehicle may be traveling. Considerable clearance must be provided between the tips of the fan blade and the orifice in the radiator shroud to allow such movement to occur without the tips of the fan blades engaging the periphery of the orifice.

In trucks, for example, it is common practice to provide clearances of one to two inches between the fan tips and the shroud to accommodate the large relative movement. Such large clearances result in air recirculation and loss of efficiency in the fan construction. As a consequence, in order to adequately cool such engines, it is necessary to employ radiators and fans considerably larger than those theoretically necessary.

Because of the general trend to the use of higher horsepower engines, particularly in vehicles, and the resulting greater cooling requirement, the practical limits for frontal area of radiators have, for all intents and purposes, been reached. In conventional trucks, an increase in radiator size would reduce the operator's visibility, while with cab over engine trucks, increasing the size of the radiators would require a reduction in the leg room for the operator. The situation is further complicated by the trend towards the use of air conditioning and automatic transmissions on such trucks with the corresponding additional heat load to the cooling system.

Moreover, concern for emissions of engines and increasingly stringent regulations appear to require a greater heat rejection per horse power from the engine to achieve emission standards, again increasing the heat load. Regulations regulating noise level are of consequence as well. Fans are large contributors to the overall noise generated by vehicles, the noise generated being proportional to fan speed.

Thus, there is a real need for a fan construction wherein fan speed may be reduced to lower noise levels while the air flow generated by the fan is increased to accommodate increasing cooling requirements in such systems.

SUMMARY OF THE INVENTION

It is the principal object of the invention to provide a new and improved fan construction. More specifically, it is an object of the invention to provide such a fan construction wherein fan efficiency is maximized to increase air flow for a given fan construction while minimizing the noise output of the same by minimizing the clearance between the tips of the fan blades and the orifice in which the fan rotates.

An exemplary embodiment of the invention achieves the foregoing object in a construction including a hub having means on one side adapted to be associated with a shaft for a fan on an internal combustion engine. A plurality of generally radially extending spokes are secured to the hub and an elastomeric, resilient ring is mounted on the ends of the spokes. The ring has a circular opening generally concentric with the hub and its radially outer portion is adapted to sealingly and slidably engage a radiator surface or the like. The construction is adapted to be disposed on a fan such that the fan circulates within the opening with the tips clearing the ring by distances on the order of fractions of inches. The ring's position with respect to the fan remains constant by reason of it being mounted upon the fan shaft and movements of the engine relative to the radiator are accommodated without interrupting fan efficiency by the sliding, sealing contact of the ring with a part of the radiator construction.

It is contemplated that the support be perforate and, when spokes are employed, have ends directed toward the engine on which the construction is used which ends carry a reinforcing ring.

In a highly preferred construction, both rings are slotted to allow introduction of a fan belt to a fan with which the construction may be used without disassembling the construction from the fan assembly. Selectively operable releasable locking means are employed for locking the severed ends of the rings togeher.

In a highly preferred embodiment, the fan shaft includes means for mounting the shaft on an engine and the hub is secured to the fan shaft oppositely of such mounting means.

Where a metal reinforcing ring for the elastomeric ring is utilized, it is preferable that the metal ring be spaced radially outwardly of the edge of the opening in the elastomeric ring so that in the event the fan blades contact the shroud assembly, they will contact only the elastomeric ring so as to avoid damaging the tips of the fan blade.

In a highly preferred embodiment, the shroud is in the form of a ring having a substantial radially extending direction and is somewhat frusto-conical, the minor base facing the mounting means for the shaft.

Other objects and advantages will become apparent from the following specification taken in connection with the accompanying drawings.

DESCRIPTION OF THE DRAWINGS

FIG. 3 is an enlarged, fragmentary elevation illustrating means on the construction for facilitating the changing of fan belts; and FIG. 4 is a sectional view taken approximately along the line 4—4 of FIG. 3.

DESCRIPTION OF THE PREFERRED EMBODIMENT

Figure 1:
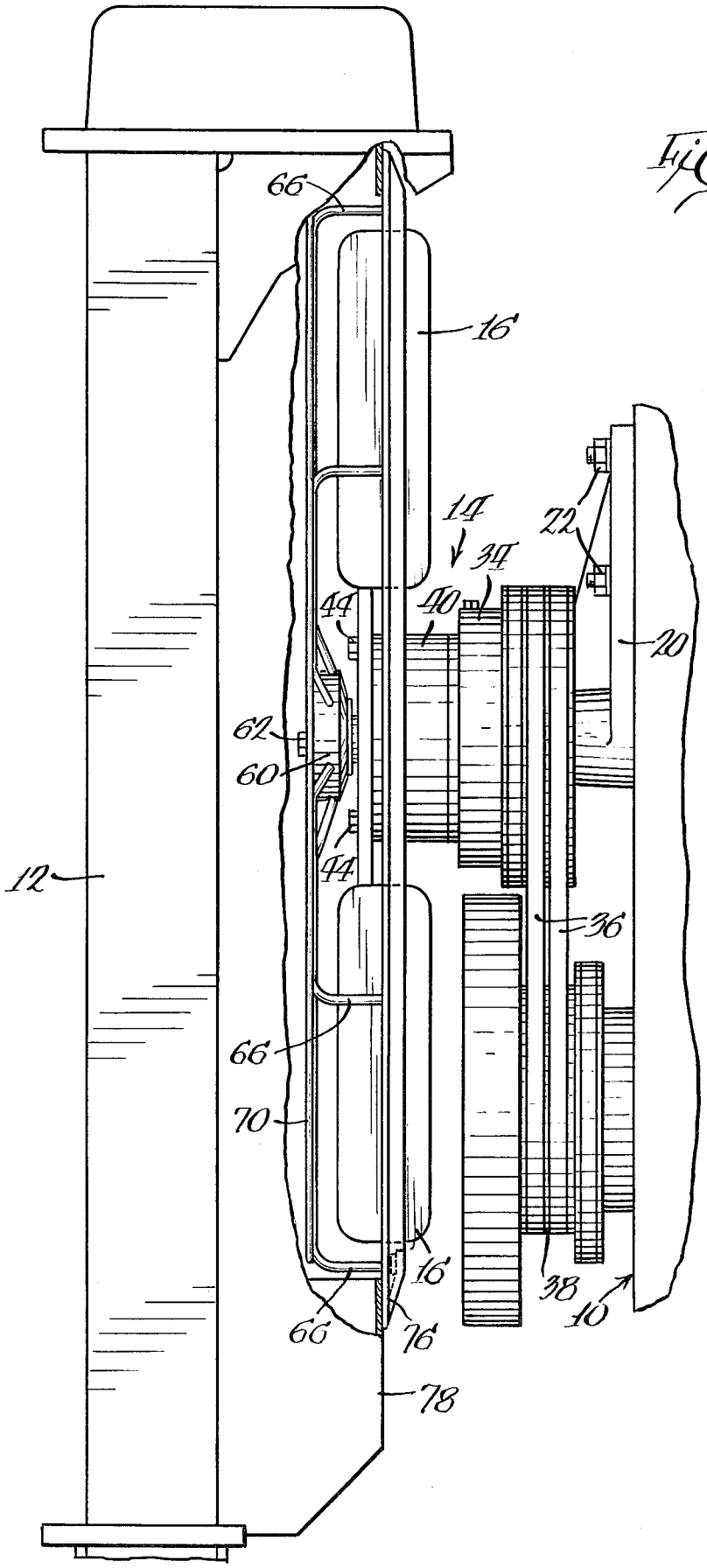
FIG. 1 is a plan view of an improved fan construction made according to the invention shown in connection with an engine and a radiator for the cooling system therefor.

An exemplary embodiment of an improved fan construction made according to the invention is illustrated in the drawings in connection with an internal combustion engine, fragmentarily shown at 10, of the type wherein a liquid coolant is circulated through a radiator core 12. A fan construction, generally designated 14, is mounted on the engine 10 and includes plural blades 16 which rotate within an opening in a housing 18 extending toward the engine 10 from the radiator core 12. For purposes to be seen, the rear surface of the housing 10 about the opening is planar, as best seen in FIG. 1.

Figure 2:
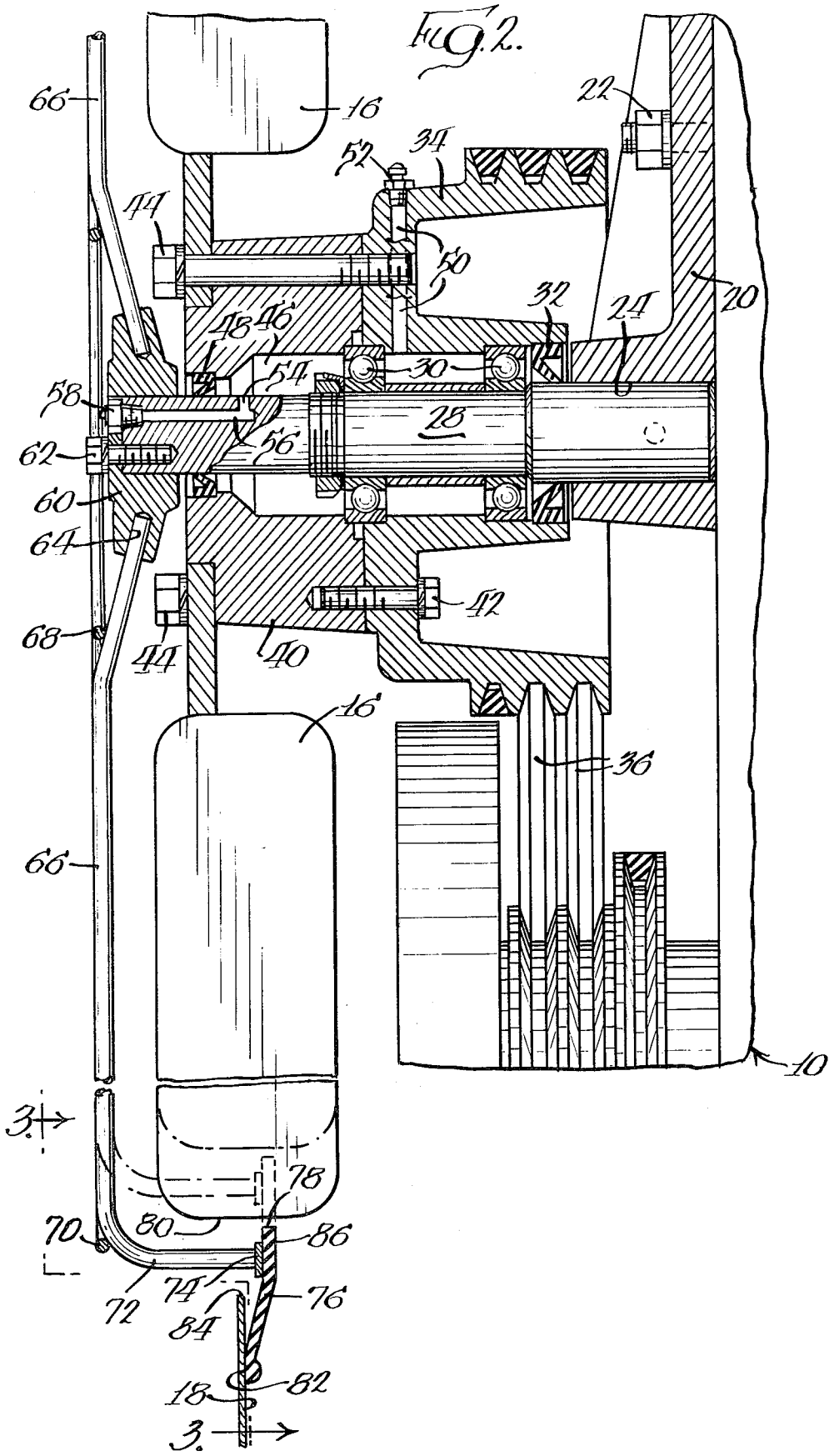
FIG. 2 is an enlarged, fragmentary vertical section of the improved fan construction.

With reference to FIG. 2, the fan construction 14 includes a mounting casting 20 which may be secured by bolts 22 to studs or the like extending from the engine block 10. The casting 20 includes a bore 24 which fixedly receives one end of a shaft 26. The shaft 26, intermediate its ends, has a first reduced diameter portion 28 which mounts bearings 30. A seal 32 is mounted on the shaft 26 adjacent the rightmost bearing 30.

A sheave 34 is journalled on the shaft 26 by means of the bearings 30 for rotation thereabout and, as seen in FIG. 1, may be driven by V-belts 36 trained thereabout, which belts 36 may also be trained about a sheave 38 driven by the engine 10.

A hub 40 is secured by bolts 42 to the sheave 40 for rotation therewith and, by means of bolts 44, mounts the fan blades 16. The hub 40 includes a lubricant receiving cavity 46 which is closed by a seal 48 at the left-hand end thereof, which seal also engages the shaft 26. A radially extending passage 58 in the sheave 34 terminates in a grease fitting 52 and lubricant may be introduced into the assemblage through the fitting 52.

The left-hand end of the shaft 26 includes a radially extending passage 54 joined to an axially extending passage 56 which is closed by a plug 58. When the assemblage is to be lubricated, the plug 58 may be removed to bleed the cavity 46 of air.

A hub or mounting means 60 is disposed on the end of the shaft 26 remote from the casting 20 and is fixedly secured thereto by a bolt 62 threadably received in the shaft 26. Bores 64 in the hub 60 mount a plurality of radially extending spokes 66. Adjacent the radially inner ends of the spokes 66 there is located a reinforcing ring 68 which is suitably secured to each of the spokes 66.

A similar reinforcing ring 70 is secured to each of the spokes 66 adjacent their radially outer extremities.

Each of the spokes 66 includes an axially directed end 72 which is directed toward the engine 10, that is, in the same direction as the end of the hub 60 which receives the shaft 26. A metal reinforcing ring 74 is secured to the inturned ends 72 of the spokes 66 and in turn mounts an elastomeric, resilient, sealing ring 76. The ring 76 may be formed of any elastomeric material which will remain flexible at the low temperatures to which the construction may be exposed, normally, −40° F., and which is inert to petrochemicals.

As best seen in FIG. 2, the ring 76 has an inner diameter or edge 78 formed by a circular opening spaced just slightly from the tips 80 of the blades 16. Depending upon the size of the assembly, the spacing can be as little as ⅛ inch and generally will not exceed ¼ inch.

The radially outer periphery 82 of the ring 76 slidably and sealingly engages the planar rear wall of the housing 18 about the orifice 84 therein. In general, the distance between the inner edge 78 and the outer edge 82 of the ring 76 will be somewhat greater than the maximum contemplated relative movement of the engine to the radiator. As a consequence, the edge 82 will always sealingly engage the rear wall of the housing 18, even through considerable movements as shown in the dotted lines in FIG. 2.

It is also to be observed that the ring 76 is preferably slightly frusto-conical in configuration with the minor base 86 facing the engine 10. Finally, it will be observed that the inner diameter 78 is radially inwardly of the innermost location of the reinforcing ring 74. Because of the relatively close spacing involved, there is the possibility that one of the tips 80 of the blade 16 could engage the structure. In such a case, however, because of the fact that the ring 76 is formed of an elastomer, and not of metal, damage to the tips 80 would be minimal.

From the foregoing, it will be appreciated that the sealing ring 76 is mounted for movement with the engine by reason of it being supported on the shaft 26 and concentrically therewith. At the same time, by reason of its contact with the housing wall 18, such movement can be accommodated without losing the seal therebetween. As a result, clearance between the tips of the fan blade and the orifice in which the blades operate can be reduced from the present one to two inches to fractions of an inch, as little as ⅛ inch, thereby vastly increasing fan efficiency and providing increased air flow, oftentimes enabling a reduction in fan speed and therefore noise.

In order to ensure that the advantages of the construction in terms of increased efficiency are not lost due to presence of the construction when maintenance is required, particularly, the replacement of belts or the like, means are provided whereby belts may be easily introduced without disassembly of the construction.

As best seen in FIGS. 3 and 4, the ring 76 is severed by a slot 100 allowing the ends of the ring at the slot to be displaced axially of the shaft. The reinforcing ring 76 is also severed such that ends 102 and 104 overlap, as best seen in FIG. 4, the end 102 defining a tab 106. One of the spokes 66 has its end 72 slightly elongated as at 110 so as to extend through a bore 112 in the tab 102 and be slidably receivable in a bore 114 in the end 104. The spoke 76 is secured as by a weld to the tab 102.

When it is necessary to replace a fan belt having a dimension sufficiently small that it cannot be fitted about the spokes 66 and the ring 76, it is only necessary to move the spoke having the elongated end 110 against its inherent resilience sufficiently to remove the end 110 from the bore 114 to unlock the severed ends of the rings 74 and 76. The belt may then have a looped end introduced through the gap and installed in place. Upon completion of installation of the belt, the components may be reassembled in the configuration illustrated in FIG. 4.

In some cases, particularly where some axial shifting of the engine occurs, the spokes 66 may be "preloaded," that is, deflected to the right, as viewed in FIGS. 1 and 2, when installed, to resiliently urge the ring 76 toward the left, as viewed in FIGS. 1 and 2. The application of the bias will ensure sealing contact between the ring 76 and the housing 18 even though substantial axial shifts may occur. The bias also compensates for installation tolerances and provides for the application of a positive sealing force to the ring 76 for all operating conditions.

From the foregoing, it will be appreciated that a fan construction made according to the invention eliminates the need for the relatively large gaps between the tips of the fan blades and the edge of the orifice in which the blades rotate. As a consequence, air flow is improved to thereby increase cooling efficiency of a radiator of a given size. At the same time, fan speed may be lowered to decrease noise levels.

What is claimed is:

1. An improved fan construction for use with engines utilizing circulating liquid coolant and radiators, said fan construction comprising:

a shaft;

means secured to said shaft for mounting said shaft on an engine;

a sheave journalled on said shaft;

fan blades carried by said sheave and rotatable therewith;

a radially extending annular ring of elastomeric material about said fan blades and having an inner diameter spaced slightly radially outwardly of the tips of said fan blade and an outer periphery, the surface of said ring remote from said securing means being a sealing surface and extending generally radially of the shaft to slidably, peripherally, sealingly engage the exterior of a radiator shroud or the like about the periphery of an orifice therein; and a perforate support for said ring, said support being secured to said ring and to said shaft, to fixedly position said ring inner diameter with respect to said tips.

2. The fan construction of claim 1 further including a metal reinforcing ring for said elastomeric ring and secured to said elastomeric ring near said inner diameter.

3. The fan construction of claim 2 wherein said support comprises a plurality of struts extending generally radially from said shaft.

4. The fan construction of claim 3 wherein said rings are severed and said reinforcing ring includes overlapping ends, and wherein one of the struts is secured to one end of the reinforcing ring and includes an axially extending stub, the other end of said reinforcing ring including an aperture receiving said stub to lock the ends together.

5. An improved fan construction for use with engines utilizing circulating liquid coolant and radiators, said fan construction comprising:

a shaft;

means secured to said shaft for mounting said shaft on an engine;

a sheave journalled on said shaft;

fan blades carried by said sheave and rotable therewith;

an annular ring of elastomeric material about said fan blades and having an inner diameter spaced slightly radially outwardly of the tips of said fan blade and an outer periphery adapted to slidably, peripherally, sealingly engage a radiator shroud or the like about the periphery of an orifice therein; and a perforate support for said ring, said support being secured to said ring and to said shaft;

said ring including a slot extending between said inner diameter and said outer periphery whereby a belt of lesser periphery than said ring can be disposed on said sheave through said slot without disassembly of said support and said ring from said shaft.

6. The fan construction of claim 5 further including a reinforcing ring secured to said support and mounting said elastomeric ring, said reinforcing ring being severed in the vicinity of said slot in said elastomeric ring.

7. The fan construction of claim 6 further including releasable locking means for at least one of said rings at the slots therein.

8. An improved fan construction for use with engines utilizing circulating liquid coolant and radiators, said fan construction comprising:

a shaft;

means secured to said shaft for mounting said shaft on an engine;

a sheave journalled on said shaft;

fan blades carried by said sheave and rotable therewith;

an annular ring of elastomeric material about said fan blades and having an inner diameter spaced slightly radially outwardly of the tips of said fan blade and an outer periphery adapted to slidably, peripherally, sealingly engage a radiator shroud or the like about the periphery of an orifice therein; and a perforate support for said ring, said support being secured to said ring and to said shaft;

said elastomeric ring being somewhat frusto-conical and having its minor base facing said mounting means.

9. A fan shroud comprising:

a hub having means on one side adapted to be associated with a fan shaft;

a plurality of generally radially extending spokes secured to said hub, the ends of said spokes remote from said hub being axially directed toward said hub one side;

a reinforcing ring secured to said spoke ends; and a slightly frusto-conical elastomeric, resilient ring mounted on said spoke ends and having a circular opening at its minor base generally concentric with said hub, the major base of said resilient ring including a sealing surface adapted to slidably and sealingly engage a radiator or the like.

10. A fan shroud comprising:

a hub having means on one side adapted to be associated with a fan shaft;

a plurality of generally radially extending spokes secured to said hub, the ends of said spokes remote from said hub being axially directed toward said hub one side;

a reinforcing ring secured to said spoke ends, and an elastomeric resilient ring mounted on said spoke with said hub, the radially outer portion of said resilient ring being adapted to slidably and sealingly engage a radiator or the like;

both said rings being severed to allow easy replacement of a fan belt and further including means for releasably locking the severed ends of said rings together.

11. An improved fan construction comprising:

a shaft;

a sheave journalled on said shaft;

a plurality of fan blades carried by said sheave and rotatable therewith;

a resilient seal flap axially spaced from said sheave and extending radially of the shaft and having a circular opening concentric with said shaft and of a diameter slightly greater than the diameter of the path of movement of said fan blades and said seal flap having a sealing surface spaced radially outwardly from said opening and on the side thereof remote from said sheave for sealingly, slidably engaging a radiator or the like;

perforate support means secured to said shaft for supporting said flap about said fan blades.

* * * * *